US011486256B2

(12) United States Patent
Quach et al.

(10) Patent No.: US 11,486,256 B2
(45) Date of Patent: Nov. 1, 2022

(54) VANE ARC SEGMENT WITH CONFORMAL THERMAL INSULATION BLANKET

(71) Applicant: RAYTHEON TECHNOLOGIES CORPORATION, Farmington, CT (US)

(72) Inventors: San Quach, Southington, CT (US); Tyler G. Vincent, Portland, CT (US); Cheng Gao, Chula Vista, CA (US); Howard J. Liles, Newington, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 0 days.

(21) Appl. No.: 17/113,166

(22) Filed: Dec. 7, 2020

(65) Prior Publication Data

US 2022/0178260 A1 Jun. 9, 2022

(51) Int. Cl.

| | |
|---|---|
| ***F01D 5/18*** | (2006.01) |
| ***F01D 5/14*** | (2006.01) |
| ***F01D 5/28*** | (2006.01) |
| ***F01D 25/24*** | (2006.01) |
| ***F01D 9/04*** | (2006.01) |

(52) U.S. Cl.

CPC ..... *F01D 5/18* (2013.01); *F01D 5/147* (2013.01); *F01D 5/284* (2013.01); *F05D 2260/231* (2013.01); *F05D 2260/30* (2013.01); *F05D 2300/6033* (2013.01)

(58) Field of Classification Search

CPC . F01D 5/18; F01D 5/189; F01D 5/282; F01D 5/188; F01D 5/14; F01D 5/30; F01D 5/3084; F01D 9/042; F01D 9/065; F01D 9/041; F01D 9/02; F01D 9/04; F01D 11/001; F01D 11/08; F01D 11/005; F01D 25/005; F01D 25/12; F01D 25/246; F01D 25/28; F01D 25/145; F01D 5/147; F01D 5/284; F05D 2240/12; F05D 2240/80; F05D 2260/38; F05D 2260/231; F05D 2260/30; F05D 2300/6033

See application file for complete search history.

(56) References Cited

U.S. PATENT DOCUMENTS

| | | | | |
|---|---|---|---|---|
| 4,768,924 | A * | 9/1988 | Carrier | F01D 5/284 415/138 |
| 6,648,597 | B1 | 11/2003 | Wildrig et al. | |
| 7,625,170 | B2 | 12/2009 | Greene et al. | |
| 8,292,580 | B2 * | 10/2012 | Schiavo | F01D 5/189 416/96 A |
| 10,329,950 | B2 | 6/2019 | Freeman et al. | |
| 10,767,497 | B2 | 9/2020 | Vetters et al. | |
| 2020/0248569 | A1 * | 8/2020 | Whittle | F01D 25/162 |

FOREIGN PATENT DOCUMENTS

| | | |
|---|---|---|
| WO | 2020018090 | 1/2020 |

* cited by examiner

*Primary Examiner* — Eric J Zamora Alvarez

(74) *Attorney, Agent, or Firm* — Carlson, Gaskey & Olds, P.C.

(57) ABSTRACT

A vane arc segment includes an airfoil piece that defines first and second platforms and a hollow airfoil section that has an internal cavity and extends between the first and second platforms. The first platform defines a gaspath side, a non-gaspath side, and a flange that projects from the non-gaspath side. Support hardware supports the airfoil piece via the flange. There is a conformal thermal insulation blanket disposed on the flange.

20 Claims, 5 Drawing Sheets

VANE ARC SEGMENT WITH CONFORMAL THERMAL INSULATION BLANKET

BACKGROUND

A gas turbine engine typically includes a fan section, a compressor section, a combustor section and a turbine section. Air entering the compressor section is compressed and delivered into the combustion section where it is mixed with fuel and ignited to generate a high-speed exhaust gas flow. The high-speed exhaust gas flow expands through the turbine section to drive the compressor and the fan section. The compressor section may include low and high pressure compressors, and the turbine section may also include low and high pressure turbines.

Airfoils in the turbine section are typically formed of a superalloy and may include thermal barrier coatings to extend temperature capability and lifetime. Ceramic matrix composite ("CMC") materials are also being considered for airfoils. Among other attractive properties, CMCs have high temperature resistance. Despite this attribute, however, there are unique challenges to implementing CMCs in airfoils.

SUMMARY

A vane arc segment according to an example of the present disclosure includes an airfoil piece that defines first and second platforms and a hollow airfoil section that has an internal cavity and that extends between the first and second platforms. The first platform defines a gaspath side, a non-gaspath side, and a flange that projects from the non-gaspath side. Support hardware supports the airfoil piece via the flange. A conformal thermal insulation blanket is disposed on the flange.

In a further embodiment of any of the foregoing embodiments, the airfoil piece is ceramic and the flange is an airfoil-shaped collar.

In a further embodiment of any of the foregoing embodiments, the conformal thermal insulation blanket is selected from the group consisting of a fabric, a tape, a composite sandwich insulation, and combinations thereof.

In a further embodiment of any of the foregoing embodiments, the conformal thermal insulation blanket is the fabric and is formed of ceramic fibers.

In a further embodiment of any of the foregoing embodiments, the conformal thermal insulation blanket is the tape and is formed of ceramic fibers.

In a further embodiment of any of the foregoing embodiments, the conformal thermal insulation blanket is the composite sandwich insulation and is formed of metal foil face sheets with a ceramic fiber core sandwiched there between.

A further embodiment of any of the foregoing embodiments includes at least one clip securing the conformal thermal insulation blanket on the flange.

In a further embodiment of any of the foregoing embodiments, the support hardware includes a spar that has a spar platform adjacent the first platform and a spar leg that extends from the spar platform into the internal cavity of the hollow airfoil section, and the conformal thermal insulation blanket is sandwiched between the first platform and the spar platform.

In a further embodiment of any of the foregoing embodiments, the spar platform includes a slot with a spring therein that clamps the conformal thermal insulation blanket.

In a further embodiment of any of the foregoing embodiments, the spar leg extends through the internal cavity and past the second platform, and further comprising an additional conformal thermal insulation blanket adjacent the second platform and circumscribing the spar leg.

A further embodiment of any of the foregoing embodiments includes a clip that secures the additional conformal thermal insulation blanket.

A gas turbine engine according to an example of the present disclosure includes a compressor section, a combustor in fluid communication with the compressor section, and a turbine section in fluid communication with the combustor. The turbine section has vanes disposed about a central axis of the gas turbine engine. Each of the vanes includes an airfoil piece that defines first and second platforms and a hollow airfoil section that has an internal cavity and that extends between the first and second platforms. The first platform defines a gaspath side, a non-gaspath side, and a flange projecting from the non-gaspath side, and a spar supporting the airfoil piece. The spar has a leg that extends in the internal cavity of the hollow airfoil section. There is a conformal thermal insulation blanket disposed on the flange.

In a further embodiment of any of the foregoing embodiments, the airfoil piece is ceramic and the flange is an airfoil-shaped collar.

In a further embodiment of any of the foregoing embodiments, the conformal thermal insulation blanket is selected from the group consisting of a fabric, a tape, a composite sandwich insulation, and combinations thereof.

In a further embodiment of any of the foregoing embodiments, the conformal thermal insulation blanket is the fabric and is formed of ceramic fibers.

In a further embodiment of any of the foregoing embodiments, the conformal thermal insulation blanket is the tape and is formed of ceramic fibers.

In a further embodiment of any of the foregoing embodiments, the conformal thermal insulation blanket is the composite sandwich insulation and is formed of metal foil face sheets with a ceramic fiber core sandwiched there between.

A further embodiment of any of the foregoing embodiments includes at least one clip securing the conformal thermal insulation blanket on the flange.

In a further embodiment of any of the foregoing embodiments, the spar includes a spar platform adjacent the first platform. The conformal thermal insulation blanket is sandwiched between the first platform and the spar platform, and the spar platform includes a slot with a spring therein that clamps the conformal thermal insulation blanket.

In a further embodiment of any of the foregoing embodiments, the leg extends through the internal cavity and past the second platform, and further includes an additional conformal thermal insulation blanket adjacent the second platform and circumscribing the leg, and a clip that secures the additional conformal thermal insulation blanket.

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION

Figure 1:
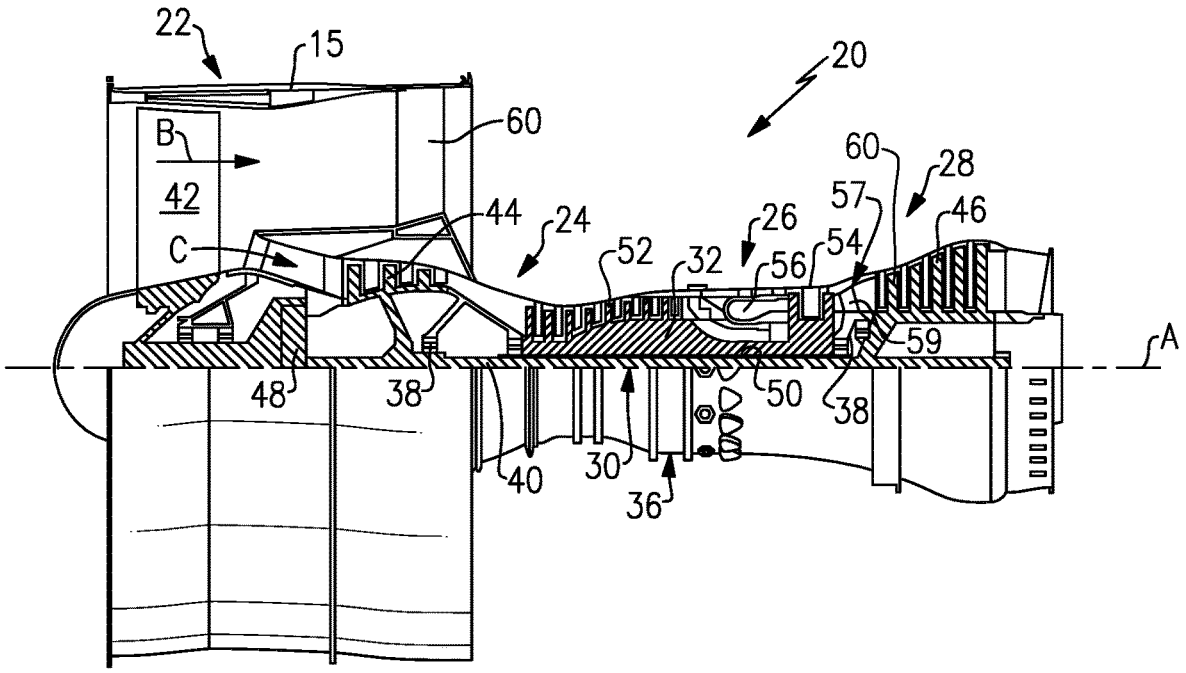
FIG. 1 illustrates a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. The fan section 22 drives air along a bypass flow path B in a bypass duct defined within a housing 15 such as a fan case or nacelle, and also drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive a fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 may be arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded through the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of the low pressure compressor, or aft of the combustor section 26 or even aft of turbine section 28, and fan 42 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1 and less than about 5:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,668 meters). The flight condition of 0.8 Mach and 35,000 ft (10,668 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed" as disclosed herein according to one non-limiting embodiment is less than about 1150 ft/second (350.5 meters/second).

Figure 2:
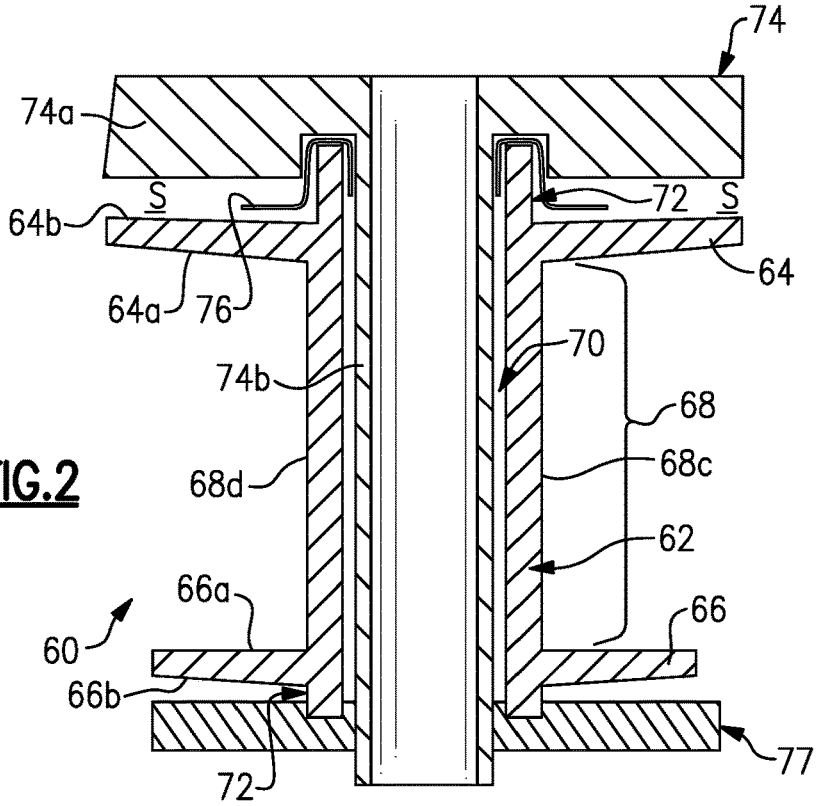
FIG. 2 illustrates a sectioned view of a vane arc segment.

FIG. 2 illustrates a sectioned view through a vane arc segment 60 of a vane ring assembly from the turbine section 28 of the engine 20. The vane arc segments 60 are situated in a circumferential row about the engine central axis A. Although the vane arc segment 60 is shown and described with reference to application in the turbine section 28, it is to be understood that the examples herein are also applicable to structural vanes in other sections of the engine 20.

Figure 3:
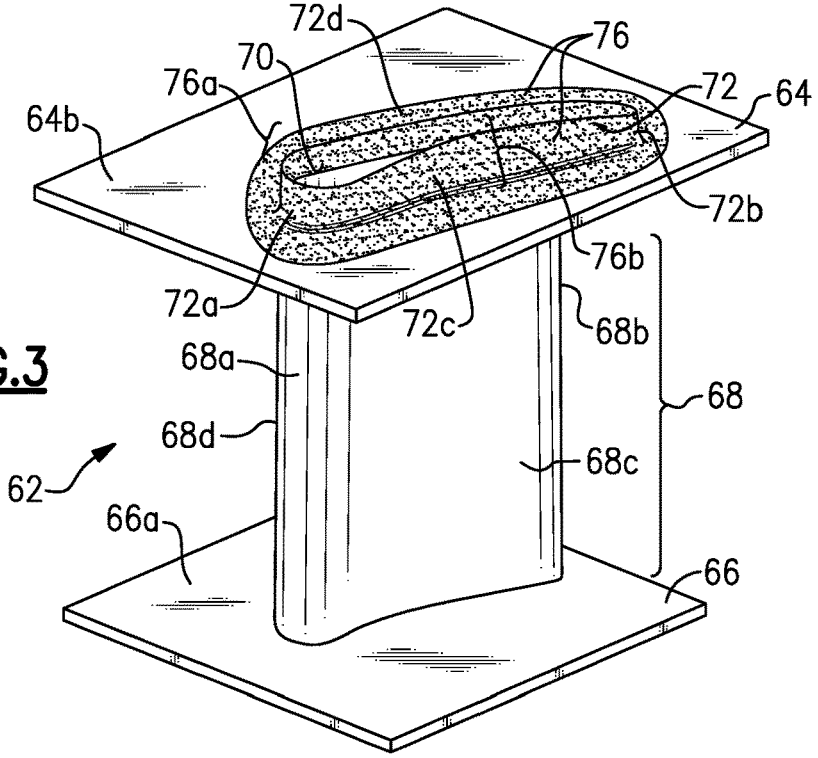
FIG. 3 illustrates an airfoil piece of a vane arc segment.

The vane arc segment 60 is comprised of an airfoil piece 62, which is also shown in isolated view in FIG. 3. The airfoil piece 62 includes several sections, including first and second platforms 64/66 and an airfoil section 68 that extends between the first and second platforms 64/66. The airfoil section 68 defines a leading edge 68*a*, a trailing edge 68*b*, and pressure and suction sides 68*c*/68*d*. The airfoil section 68 generally circumscribes a central cavity 70 such that the airfoil section 68 in this example is hollow. The terminology "first" and "second" as used herein is to differentiate that there are two architecturally distinct components or features. It is to be further understood that the terms "first" and "second" are interchangeable in the embodiments herein in that a first component or feature could alternatively be termed as the second component or feature, and vice versa.

In this example, the first platform 64 is a radially outer platform and the second platform 66 is a radially inner platform relative to the engine central longitudinal axis A. The first platform 64 defines a gaspath side 64*a* and a non-gaspath side 64*b*. Likewise, the second platform 66 defines a gaspath side 66*a* and a non-gaspath side 66*b*. The gaspath sides 64*a*/66*a* bound the core flow path C through the engine 20.

The platform 64 further includes a flange 72 that projects from the non-gaspath sides 64*b*. In this example, the flange 72 is an airfoil-shaped collar that is in essence a radial extension of the airfoil section 68 past the platform 64. In this regard, the flange 72 has a leading end 72*a*, a trailing end 72*b*, a concave side 72*c*, and a convex side 72*d*. The flange 72 serves to transfer loads, such as aerodynamic forces, from the airfoil piece 62 to support hardware 74. Likewise, the platform 66 may also include a flange 72 that engages a support hardware 77. The flanges 72 may be radial flanges that extend primarily in a radial direction as depicted, but alternatively may be another type of flange that projects from the non-gaspath sides 64*b* and bears aerodynamic loads transmitted from the airfoil piece 62.

The airfoil piece 62 is continuous in that the platforms 64/66 and airfoil section 68 constitute a one-piece body. As an example, the airfoil piece 62 is formed of a ceramic material, an organic matrix composite (OMC), or a metal matrix composite (MMC). For instance, the ceramic material is a ceramic matrix composite (CMC) that is formed of ceramic fibers that are disposed in a ceramic matrix. The ceramic matrix composite may be, but is not limited to, a SiC/SiC ceramic matrix composite in which SiC fibers are disposed within a SiC matrix. Example organic matrix composites include, but are not limited to, glass fiber, carbon fiber, and/or aramid fibers disposed in a polymer matrix, such as epoxy. Example metal matrix composites include, but are not limited to, boron carbide fibers and/or alumina fibers disposed in a metal matrix, such as aluminum. The fibers may be provided in fiber plies, which may be woven or unidirectional and may collectively include plies of different fiber weave configurations.

The vane arc segment 60 may be mounted in the engine 20 by the support hardware 74/77. For example, the support hardware 74 is a spar that includes a spar platform 74*a* and a spar leg 74*b*. The spar leg 74*b* extends radially from the spar platform 74*a* through the internal cavity 70 of the airfoil section 68 and radially past the second platform 66, where it is secured with the support hardware 77. In this example, the spar leg 74*b* is hollow and may be provided with pass-through air for cooling downstream components and/or cooling air used to cool a portion of the airfoil piece 62. The support hardware 74/77 is formed of metallic alloy that can bear the loads received, such as nickel—or cobalt-based superalloys. It is to be appreciated that the support hardware 74 may vary from the configuration as a spar. For instance, the support hardware 74 may alternatively be a platform, without a spar leg.

In general, the materials contemplated for the airfoil piece 62 have significantly lower thermal conductivity than superalloys and do not possess the same strength and ductility characteristics, making them more susceptible to distress from thermal gradients and the thermally induced stresses those cause. The high strength and toughness of superalloys permits resistance to thermal stresses, whereas by comparison materials such as ceramics are more prone to distress from thermal stress. Thermal stresses may cause distress at relatively weak locations, such as interlaminar interfaces between fiber plies where there are no fibers carrying load. Therefore, although maximized cooling may be desirable for superalloy vanes, cooling in some locations for non-superalloy vanes may exacerbate thermal gradients and thus be counter-productive to meeting durability goals.

In particular in the vane arc segment 60, there may be a flow of cooling air in the space S between the support hardware 74 and the airfoil piece 62. In general, such cooling air is destined elsewhere but unintendedly flows into the space S. For example, the cooling air may come from the mate faces between adjacent vane arc segments 60, as leakage from the internal cavity 70, and/or as leakage from the internal cavity in the spar leg 74*b*. The cooling air in the space S may cause thermal gradients across the flange 72 and platform 64. Since the flange 72 serves to transfer loads, thermal gradients from this cooling air and the induced thermal stresses caused in the flange may reduce load-bearing capability and/or durability.

Figure 4:
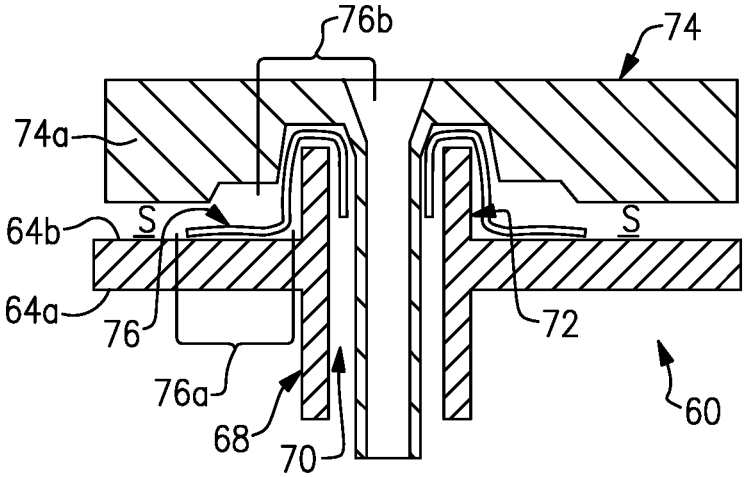
FIG. 4 illustrates a thermal insulation blanket in a vane arc segment.

In this regard, as shown in FIG. 4, the vane arc segment 60 further includes a conformal thermal insulation blanket 76 disposed on the radial flange 72. The conformal thermal insulation blanket 76 is a pliable fibrous structure containing ceramic fibers, most typically provided as a layer or layers. For example, the ceramic fibers are provided as a woven or non-woven fabric. The ceramic of the fibers must be capable of withstanding the operating temperatures in the vane arc segment 60, which may exceed 700° C. For instance, the ceramic may be, but is not limited to, silicon containing oxides, silicates, borosilicates, aluminosilicates, and combinations thereof.

The blanket 76 facilitates shielding the surfaces of the flange 72 and platform 64 from convective flow of the cooling air and insulating the surfaces to reduce heat loss, thereby helping to reduce thermal gradients across the flange 72. Additionally, as the blanket 76 takes up a portion of the space S, it may also serve as a seal to facilitate reducing leakage. The blanket 76 is pliable and thus is able to generally conform to the shape of the platform 64 and flange 72 but is not necessarily in constant facial contact with the surfaces of the platform 64 and flange 72. The blanket 76 is of generally uniform thickness, but alternatively may be varied in thickness to tailor the localized insulation effect and take up the space S as a seal.

As also shown in FIG. 3, the blanket 76 includes a first section 76*a* that is conformal with the non-gaspath side 64*b* of the platform 64 and a second section 76*b* that is conformal with the flange 72. The first section 76*a* circumscribes the (collar) flange 72. The second section 76*b* extends up the outside surface of the flange 72, then turns and extends across the top of the flange 72, and then turns again and extends at least part-way down the inside surface of the flange 72 that bounds the internal cavity 70.

The blanket 76 may be formed from a single, continuous piece of insulation. In this regard, the blanket 76 may be provided with slits, slots, holes, or the like to enable conforming the blanket 76 to the flange 72. If desired, the blanket 76 may have openings or slots that permit a portion of the flange 72 to contact the spar platform 74*a*. Alternatively, the blanket may be provided as multiple pieces that are arranged side-by-side or in an overlapping manner. The conformance of the blanket 76 around the flange 72, coupled with being sandwiched between the airfoil piece 62 and the support hardware 74, serves to self-secure the blanket 76 in place. There is otherwise no additional external securement or bonding of the blanket 76 in this example.

Figure 5:
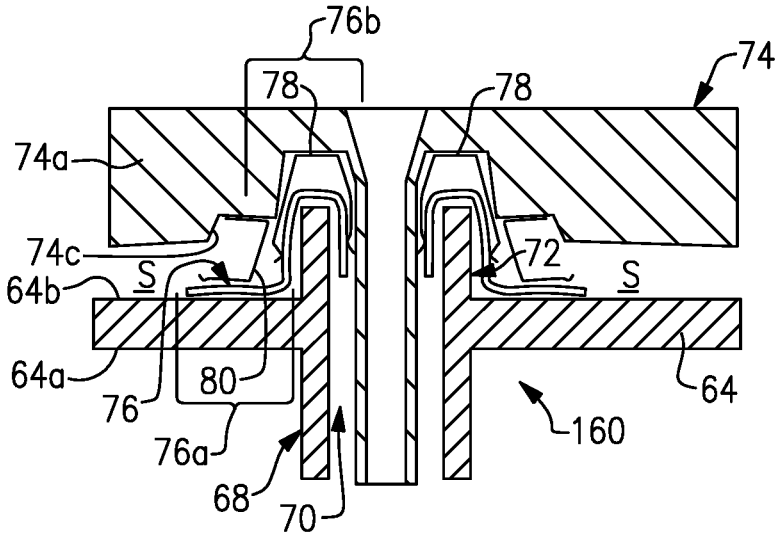
FIG. 5 illustrates a thermal insulation blanket with clips.

FIG. 5 illustrates another example vane arc segment 160. In this disclosure, like reference numerals designate like elements where appropriate and reference numerals with the addition of one-hundred or multiples thereof designate modified elements that are understood to incorporate the same features and benefits of the corresponding elements. In this example, the vane arc segment 160 is identical to the vane arc segment 60 but additionally includes at least one clip 78 that secures the blanket 76 on the flange 72. For instance, the clip 78 is formed of metal, such as a nickel—or cobalt-based superalloy, and is relatively thin so as to have a resilience that enables the clip 78 to pinch onto the blanket 76 and flange 72 in order to hold the blanket 76 in place, which may have some tendency to shift due to engine vibration and/or relative movement between the support hardware 74 and airfoil piece 62.

The clip 78 may be discrete or continuous. For instance, a discrete version of the clip 78 extends along only a portion of the length of the flange 72, while a continuous version of the clip 78 extends entirely along the flange (entirely around the collar). The discrete version primarily serves for securing the blanket 76. The continuous version serves to both secure the blanket and facilitate sealing by pressing the blanket 76 more tightly against the flange 72 to reduce gaps that might otherwise permit cooling air flow. If further securement of the blanket 76 is desired, the spar platform 74*a* is provided with a slot 74*c* and a spring 80 therein that presses the blanket 76 against the surface of the platform 64. The slot 74*c* serves to retain the clip 80 so that it does not work its way out of position under engine vibration.

Figure 6:
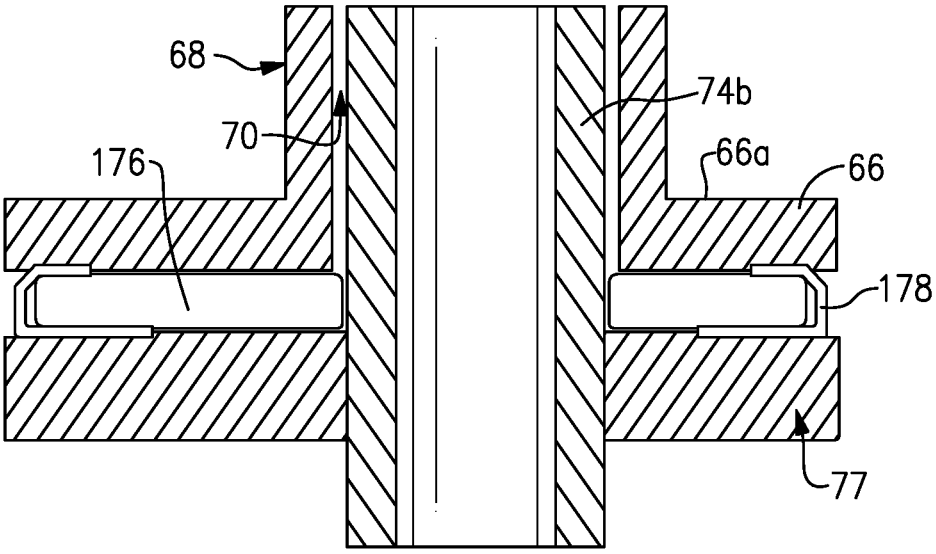
FIG. 6 illustrates another example of a thermal insulation blanket at an inner diameter end of a vane arc segment.

FIG. 6 illustrates an example at the platform 66 and support hardware 77 at the inner diameter of the vane arc segment 60 and/or 160. It is to be understood, however, that inverted configurations are also contemplated, for example where i) the platform 64 and blanket 76 in the examples above is at the inner diameter or ii) the platform 64 and blanket 76 in the examples above is at the inner diameter and the platform 66 and blanket 176 discussed below are at the outer diameter.

As shown, the leg 74*b* extends through the internal cavity 70 of the airfoil section 68 and past the second platform 66. There is an additional conformal thermal insulation blanket 176 adjacent the second platform 66 and which circumscribes the leg 74*b*. Like the blanket 76, the blanket 176 facilitates shielding the surfaces of the platform 66 from convective flow of the cooling air, insulating the surfaces to reduce heat loss, and sealing the space between the platform 66 and support hardware 77.

A clip 178 is provided to secure the blanket 176 in place. In this example, the clip 178 wraps around the edges of the blanket 176 and thereby limits in-plane movement of the blanket 176. Similar to the clip 78, the clip 178 may be discrete or continuous. In this case, the clip 178 is bonded to the support hardware 77, the platform 66, or both, such as by welding, brazing, or the like.

Figure 7:
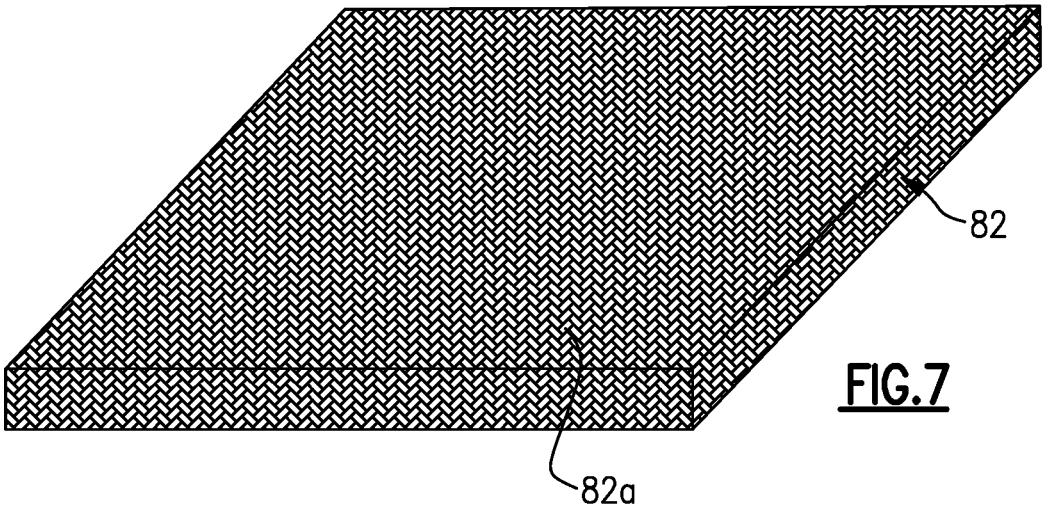
FIG. 7 illustrates a fabric of a thermal insulation blanket.

The blankets 76/176 in the examples above are independently selected from various types of blankets, including fabrics, tapes, composite sandwich insulation, or a combination of these and may be provided in a thickness that is commensurate with the size of the space between the platforms 64/66 and the support hardware 74/77. In general, for good insulation, the blanket 76/176 may be from approximately 1.2 millimeters thick to approximately 2.5 millimeters thick. FIG. 7 illustrates one example of a fabric 82. For instance, the fabric 82 is made up of ceramic fibers 82*a* that are woven or non-woven. As above, the ceramic fibers 82*a* may be, but are not limited to, silicon containing oxides, silicates, borosilicates, aluminosilicates, or combinations thereof. One further example of ceramic fibers are NEXTEL ceramic fibers by 3M Company Corporation.

Figure 8:
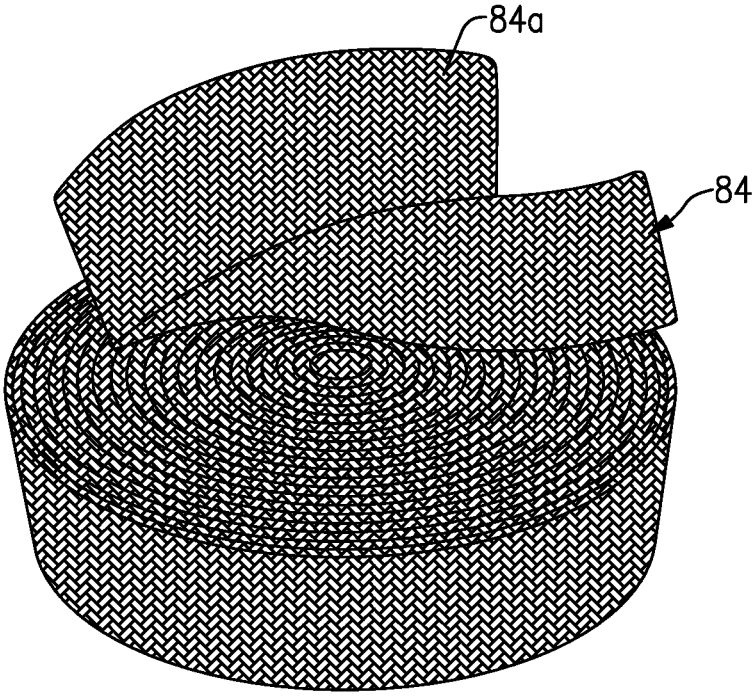
FIG. 8 illustrates a tape of a thermal insulation blanket.

FIG. 8 illustrates an example of a tape 84. For instance, similar to the fabric 82, the tape 84 is made up of ceramic fibers 84*a* that are woven or non-woven. As above, the ceramic fibers 84*a* may be, but are not limited to, silicon containing oxides, silicates, borosilicates, aluminosilicates, or combinations thereof. Optionally the tape 84 may also have a backing and/or binder that facilitates handing of the fibers 84*a*.

Figure 9:
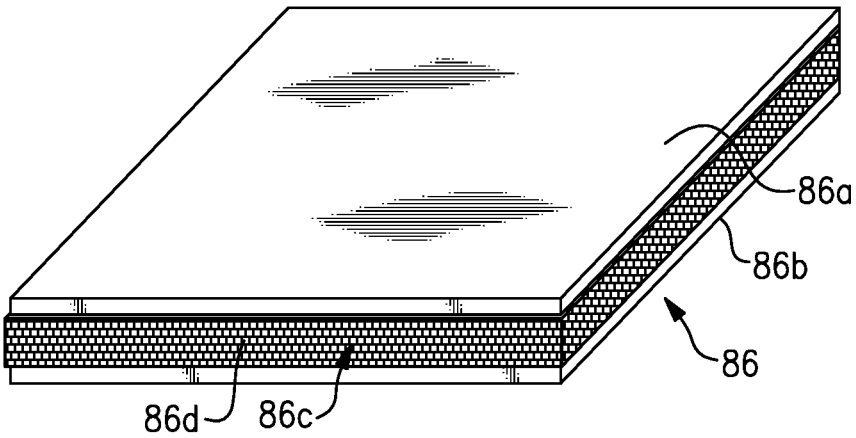
FIG. 9 illustrates a composite sandwich insulation of a thermal insulation blanket.

FIG. 9 illustrates one example of a composite sandwich insulation 86. For instance, the composite sandwich insulation 86 is formed of one or more metal foil face sheets 86*a*/86*b* with a ceramic fiber core 86*c* sandwiched there between. The core 86*c* is made up of ceramic fibers 86*d* that are woven or non-woven. As above, the ceramic fibers 86*d* may be, but are not limited to, silicon containing oxides, silicates, borosilicates, aluminosilicates, or combinations thereof.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from this disclosure. The scope of legal protection given to this disclosure can only be determined by studying the following claims.

What is claimed is:

1. A vane arc segment comprising:

an airfoil piece defining first and second platforms and a hollow airfoil section having an internal cavity and extending between the first and second platforms, the first platform defining a gaspath side, a non-gaspath side, and a flange projecting from the non-gaspath side, the flange defining a radial top face, an inside surface that bounds to a portion of the internal cavity, and an outside surface opposite the inside surface;

support hardware supporting the airfoil piece via the flange; and a conformal thermal insulation blanket extending across the radial top face of the flange.

2. The vane arc segment as recited in claim 1, wherein the airfoil piece is ceramic and the flange is an airfoil-shaped collar.

3. The vane arc segment as recited in claim 1, wherein the conformal thermal insulation blanket is selected from the group consisting of a fabric, a tape, and a composite sandwich insulation.

4. The vane arc segment as recited in claim 3, wherein the conformal thermal insulation blanket is the fabric and is formed of ceramic fibers.

5. The vane arc segment as recited in claim 3, wherein the conformal thermal insulation blanket is the tape and is formed of ceramic fibers.

6. The vane arc segment as recited in claim 3, wherein the conformal thermal insulation blanket is the composite sandwich insulation and is formed of metal foil face sheets with a ceramic fiber core sandwiched there between.

7. The vane arc segment as recited in claim 1, further comprising at least one clip securing the conformal thermal insulation blanket on the flange.

8. The vane arc segment as recited in claim 1, wherein the support hardware includes a spar that has a spar platform adjacent the first platform and a spar leg that extends from the spar platform into the internal cavity of the hollow airfoil section, the conformal thermal insulation blanket is sandwiched between the first platform and the spar platform, and the spar platform includes a slot with a spring therein that clamps the conformal thermal insulation blanket.

9. The vane arc segment as recited in claim 8, wherein the spar leg extends through the internal cavity and past the second platform, and further comprising an additional conformal thermal insulation blanket adjacent the second platform and circumscribing the spar leg.

10. The vane arc segment as recited in claim 9, further comprising a clip that secures the additional conformal thermal insulation blanket.

11. The vane arc segment as recited in claim 1, wherein, with respect to the first and second platforms and the hollow airfoil section, the airfoil piece is a continuous one-piece body.

12. The vane arc segment as recited in claim 1, wherein the conformal thermal insulation blanket extends along the outside surface of the flange, extends across the radial top face of the flange, and extends along a portion of the inside surface of the flange.

13. The vane arc segment as recited in claim 1, wherein the support hardware includes a spar that has a spar platform adjacent the first platform and a spar leg that extends from the spar platform into the internal cavity of the hollow airfoil section, and the conformal thermal insulation blanket is radially sandwiched between the first platform and the spar platform.

14. A gas turbine engine comprising:

a compressor section;

a combustor in fluid communication with the compressor section; and a turbine section in fluid communication with the combustor, the turbine section having vanes disposed about a central axis of the gas turbine engine, each of the vanes includes:

an airfoil piece defining first and second platforms and a hollow airfoil section having an internal cavity and extending between the first and second platforms, the first platform defining a gaspath side, a non-gaspath side, and a flange projecting from the non-gaspath side, a spar supporting the airfoil piece, the spar having a leg extending in the internal cavity of the hollow airfoil section, and a conformal thermal insulation blanket disposed on the flange, wherein the spar includes a spar platform adjacent the first platform, the conformal thermal insulation blanket is sandwiched between the first platform and the spar platform, and the spar platform includes a slot with a spring therein that clamps the conformal thermal insulation blanket.

15. The gas turbine engine as recited in claim 14, wherein the conformal thermal insulation blanket is selected from the group consisting of a fabric, a tape, and a composite sandwich insulation.

16. The gas turbine engine as recited in claim 15, wherein the conformal thermal insulation blanket is the fabric and is formed of ceramic fibers.

17. The gas turbine engine as recited in claim 15, wherein the conformal thermal insulation blanket is the tape and is formed of ceramic fibers.

18. The gas turbine engine as recited in claim 15, wherein the conformal thermal insulation blanket is the composite sandwich insulation and is formed of metal foil face sheets with a ceramic fiber core sandwiched there between.

19. The gas turbine engine as recited in claim 14, further comprising at least one clip securing the conformal thermal insulation blanket on the flange.

20. A vane arc segment comprising:

an airfoil piece defining first and second platforms and a hollow airfoil section having an internal cavity and extending between the first and second platforms, the first platform defining a gaspath side, a non-gaspath side, and a flange projecting from the non-gaspath side;

support hardware supporting the airfoil piece via the flange; and a conformal thermal insulation blanket disposed on the flange, wherein the support hardware includes a spar that has a spar platform adjacent the first platform and a spar leg that extends from the spar platform into the internal cavity of the hollow airfoil section, the conformal thermal insulation blanket is sandwiched between the first platform and the spar platform, and the spar platform includes a slot with a spring therein that clamps the conformal thermal insulation blanket.

* * * * *